US012509318B2

(12) United States Patent
Chokyu et al.

(10) Patent No.: US 12,509,318 B2
(45) Date of Patent: Dec. 30, 2025

(54) SHEET CONVEYANCE APPARATUS

(71) Applicant: HONDA MOTOR CO., LTD., Tokyo (JP)

(72) Inventors: Shinsuke Chokyu, Tokyo (JP); Toru Ikeda, Tokyo (JP); Kazuki Matsunaga, Tokyo (JP); Koya Shimada, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 346 days.

(21) Appl. No.: 18/098,438

(22) Filed: Jan. 18, 2023

(65) Prior Publication Data

US 2023/0234797 A1 Jul. 27, 2023

(30) Foreign Application Priority Data

Jan. 24, 2022 (JP) ..... 2022-008591

(51) Int. Cl.

| | |
|---|---|
| ***B65H 23/195*** | (2006.01) |
| ***B65H 7/02*** | (2006.01) |
| ***B65H 20/12*** | (2006.01) |
| ***B65H 23/32*** | (2006.01) |

(52) U.S. Cl.

CPC ..... *B65H 23/1955* (2013.01); *B65H 7/02* (2013.01); *B65H 20/12* (2013.01); *B65H 23/32* (2013.01); *B65H 2406/33* (2013.01)

(58) Field of Classification Search

CPC ..... B65H 20/12; B65H 23/1806; B65H 23/1955; B65H 23/32; B65H 2301/414324; B65H 2301/51122; B65H 2406/33; B65H 7/02; H01M 8/1004

See application file for complete search history.

(56) References Cited

U.S. PATENT DOCUMENTS

2005/0016670 A1* 1/2005 Kanbara ..... G02F 1/133528 156/289

FOREIGN PATENT DOCUMENTS

| | | | |
|---|---|---|---|
| JP | S53-165832 U | | 12/1978 |
| JP | 2001199624 A | * | 7/2001 |
| JP | 2003-312935 A | | 11/2003 |
| JP | 2006-044658 A | | 2/2006 |
| JP | 2021-028966 A | | 2/2021 |

OTHER PUBLICATIONS

Office Action dated Sep. 12, 2023 issued in the corresponding Japanese Patent Application No. 2022-008591 with the English machine translation thereof.

* cited by examiner

*Primary Examiner* — Philip C Tucker
*Assistant Examiner* — Jimmy R Smith, Jr.
(74) *Attorney, Agent, or Firm* — Carrier, Shende & Associates P.C.; Joseph P. Carrier; Jeffrey T. Gedeon

(57) ABSTRACT

A sheet conveyance apparatus includes an acquisition unit that acquires information indicating a peeling position where a protective film is peeled off a sheet, and a control unit that controls a roll device based on the information and moves the peeling position.

8 Claims, 10 Drawing Sheets

SHEET CONVEYANCE APPARATUS

CROSS-REFERENCE TO RELATED APPLICATIONS

This application is based upon and claims the benefit of priority from Japanese Patent Application No. 2022-008591 filed on Jan. 24, 2022, the contents of which are incorporated herein by reference.

BACKGROUND OF THE INVENTION

Field of the Invention

The present invention relates to a sheet conveyance apparatus.

Description of the Related Art

JP 2006-044658 A discloses that a label of a label sheet sent out from a supply reel is peeled off the sheet. The label disclosed in JP 2006-044658 A is partially peeled off a mount sheet by a suction head.

SUMMARY OF THE INVENTION

There is a case where a protective film is attached to one surface of the sheet and the one surface is protected by the protective film. If this protective film is not part of the final product, it must be peeled off at the time of manufacturing. In this case, for example, if a peeling-in roll is employed instead of the suction head disclosed in JP 2006-044658 A, the protective film of the sheet sent out from the supply reel can be taken up by the peeling-in roll and peeled off.

However, in this case, the peeling position where the protective film peels off the sheet tends to change according to the fluctuation of the speed of the supply reel or the peeling-in roll. When the peeling position changes, the tension applied to the sheet changes and an unnecessary load is applied to the sheet. Thus, there is concern that damage or the like may be caused to the sheet.

An object of the present invention is to solve the aforementioned problem.

An aspect of the present invention is a sheet conveyance apparatus including a roll device that guides a film-attached sheet including a sheet and a protective film attached to one surface of the sheet, a peeling unit that peels the protective film of the film-attached sheet guided by the roll device, an acquisition unit that acquires information indicating the peeling position where the protective film is peeled off the sheet, and a control unit that controls the roll device on the basis of the information and moves the peeling position.

According to the aspect of the present invention, it is possible to suppress the change of the peeling position. Accordingly, it is possible to suppress the change of the tension applied to the sheet and the application of an unnecessary load to the sheet. As a result, damage or the like to the sheet can be suppressed.

The above and other objects, features, and advantages of the present invention will become more apparent from the following description when taken in conjunction with the accompanying drawings, in which a preferred embodiment of the present invention is shown by way of illustrative example.

DETAILED DESCRIPTION OF THE INVENTION

[Sheet Conveyance Apparatus]

Figure 1:
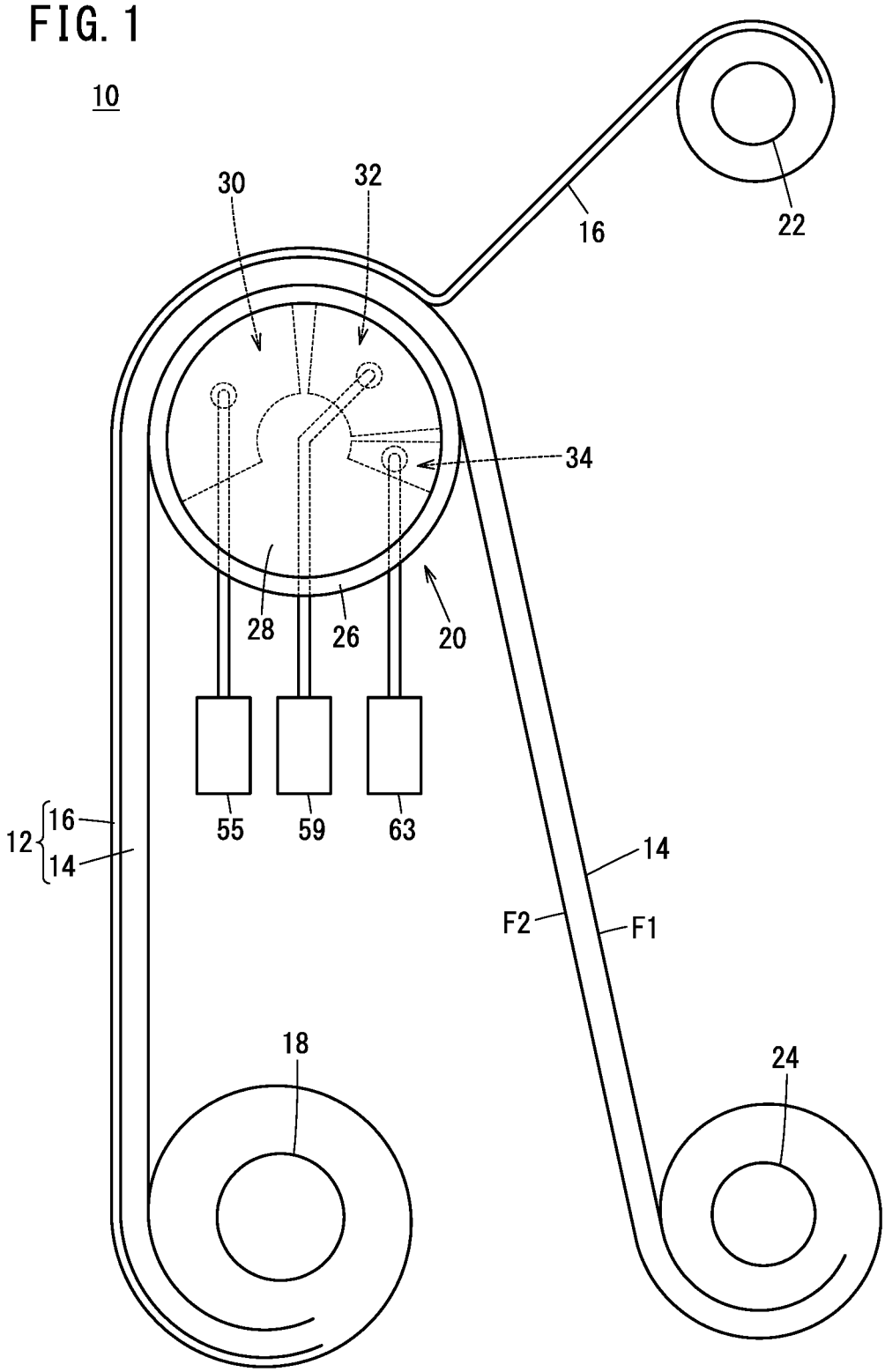
FIG. 1 is a diagram showing a sheet conveyance apparatus.

FIG. 1 is a diagram showing a sheet conveyance apparatus 10. The sheet conveyance apparatus 10 conveys a film-attached sheet 12. The film-attached sheet 12 includes a sheet 14 and a protective film 16. The sheet 14 may be a membrane electrode assembly (MEA). The membrane electrode assembly is used for a fuel cell. When the sheet 14 is the membrane electrode assembly, the sheet 14 has porosity. Note that the sheet 14 may have porosity even if the sheet 14 is not a membrane electrode assembly. The protective film 16 is attached to one surface F1 of the sheet 14. The protective film 16 can be peeled off the sheet 14. The protective film 16 may be formed of a thermoplastic resin.

The sheet conveyance apparatus 10 includes a reeling-out roll 18, a roll device 20, a peeling unit 22, and a reeling-in roll 24.

The reeling-out roll 18 feeds the film-attached sheet 12 to the roll device 20. The roll device 20 guides the film-attached sheet 12 fed from the reeling-out roll 18. The peeling unit 22 peels the protective film 16 of the film-attached sheet 12 guided by the roll device 20. The reeling-in roll 24 reels the sheet 14 in from which the protective film 16 has been peeled off.

The peeling unit 22 may be a film reeling-in roll. In this case, the peeling unit 22 reels the protective film 16 in, whereby the protective film 16 is peeled off the sheet 14 while the film-attached sheet 12 is guided by the roll device 20. FIG. 1 shows an example in which the peeling unit 22 is a film reeling-in roll.

Figure 2:
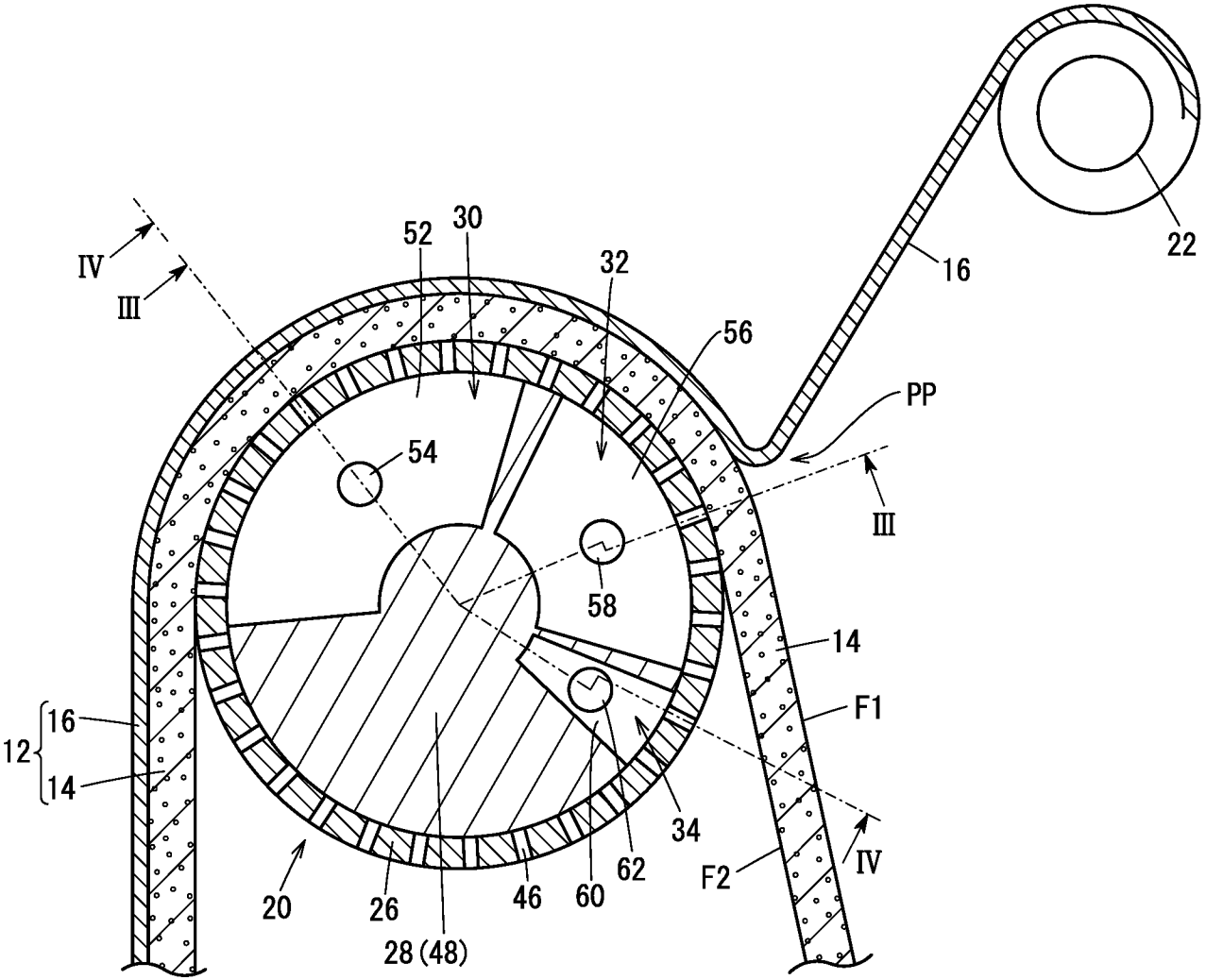
FIG. 2 is a sectional view showing a roll device.
Figure 3:
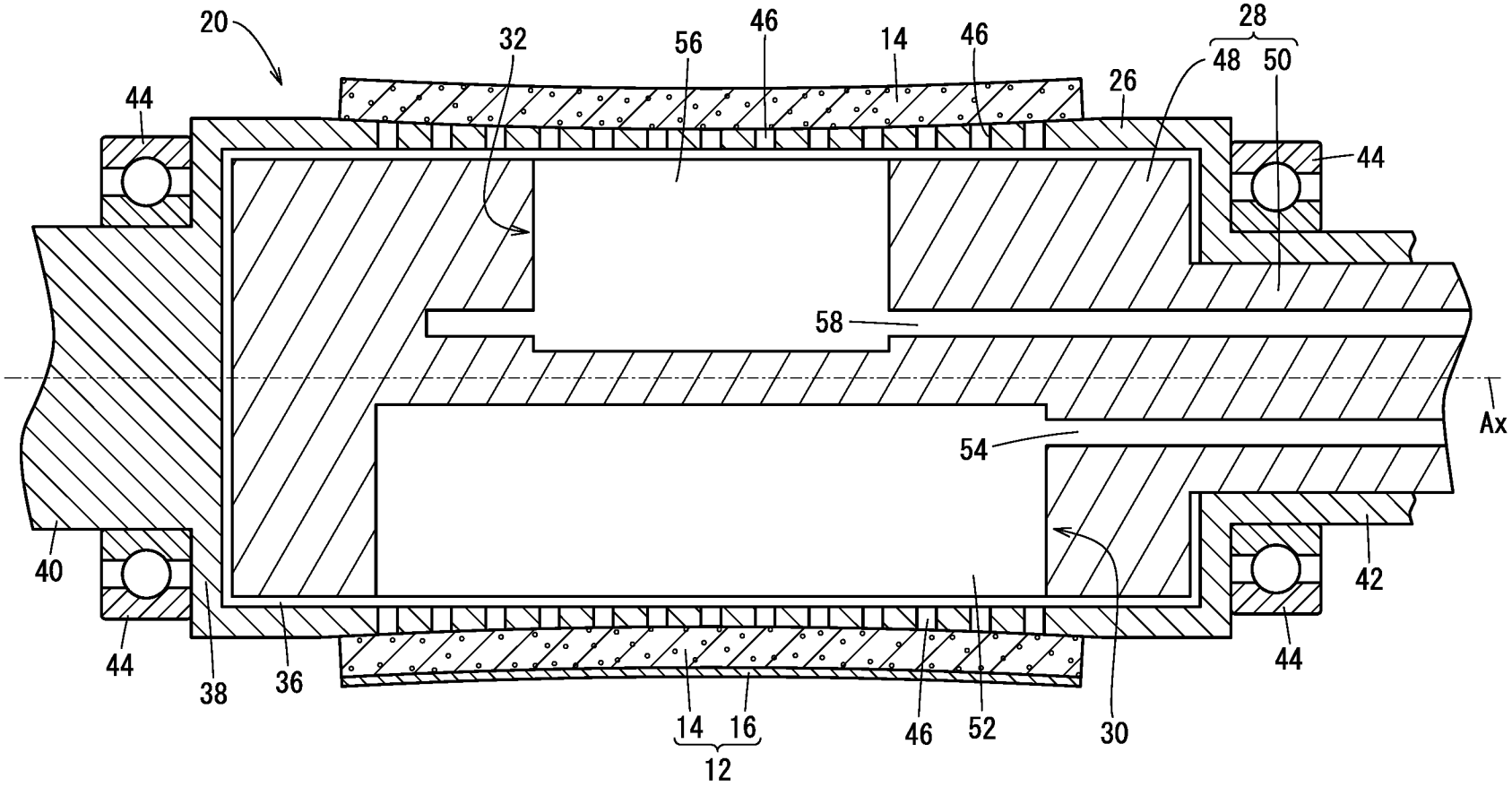
FIG. 3 is a cross-sectional view taken along a line III-III of FIG. 2.
Figure 4:
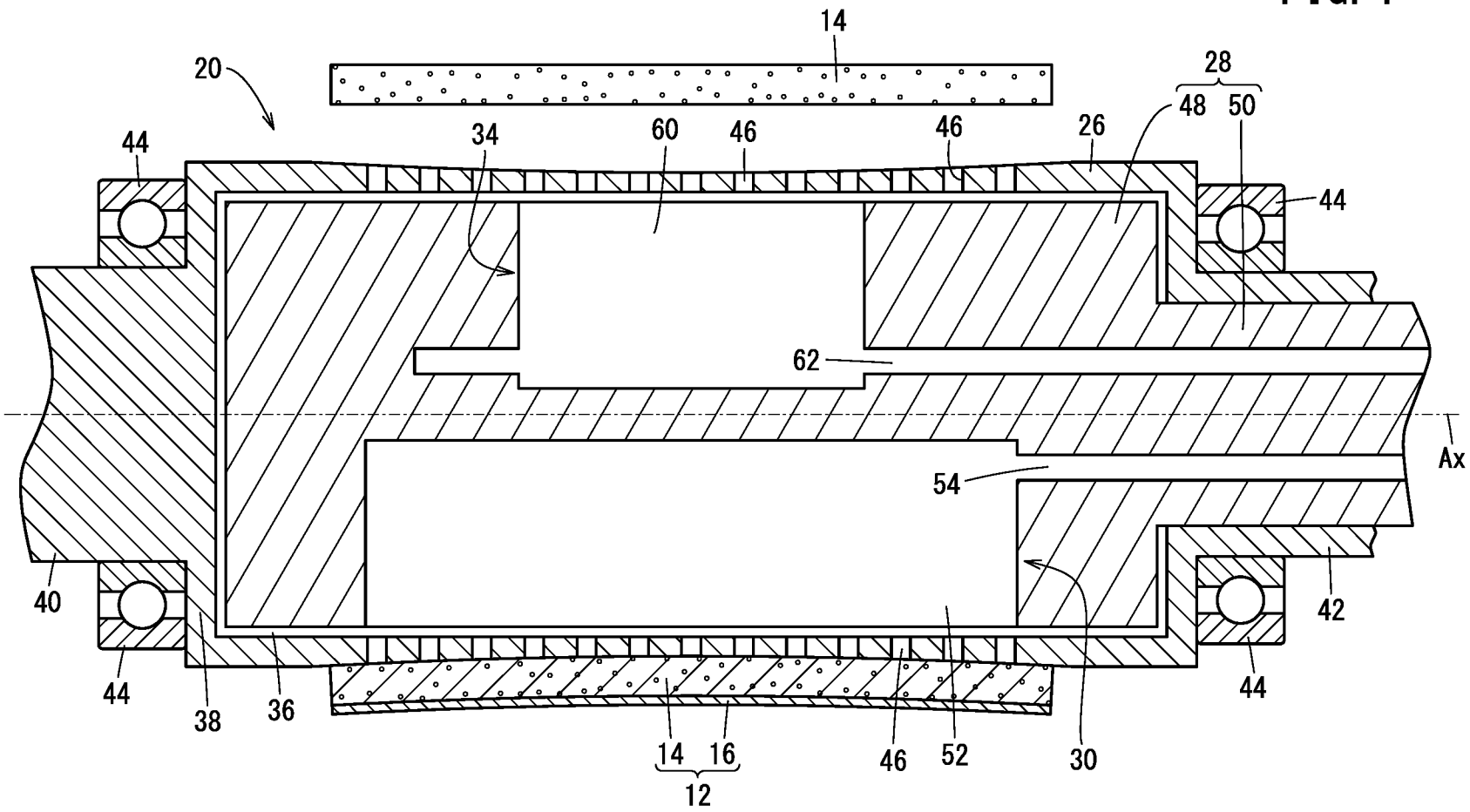
FIG. 4 is a sectional view taken along a line IV-IV of FIG. 2.

The roll device 20 will be described with reference to FIGS. 2 to 4. FIG. 2 is a sectional view showing the roll device 20. FIG. 3 is a cross-sectional view taken along a line III-III of FIG. 2. FIG. 4 is a sectional view taken along a line IV-IV of FIG. 2. The cross section of FIG. 2 is parallel to the radial direction of the roll device 20. The cross sections of FIGS. 3 and 4 are parallel to the rotary axis Ax (see FIGS. 3 and 4) of the roll device 20.

The roll device 20 includes a roller portion 26, a shaft portion 28, a heating portion 30, a suction portion 32, and a discharge portion 34.

The roller portion 26 is a member for guiding the sheet 14 of the film-attached sheet 12 fed from the reeling-out roll 18, and is formed into a substantially cylindrical shape. A part of the outer peripheral surface of the roller portion 26 comes into contact with the other surface F2 of the sheet 14 of the film-attached sheet 12 fed from the reeling-out roll 18. The other surface F2 of the sheet 14 is a surface opposite to the one surface F1 of the sheet 14 to which the protective film 16 is attached. The roller portion 26 is rotatably supported with respect to the shaft portion 28.

A hollow portion 36 (see FIGS. 3 and 4) is formed on the inner side of the roller portion 26. One end face of the roller portion 26 in the axial direction is closed by a closing portion 38 (see FIGS. 3 and 4). An axis of the roller portion 26 coincides with a rotary axis Ax (see FIGS. 3 and 4) of the roll device 20. A protruding portion 40 is provided at a central portion in the radial direction of the closing portion 38. The protruding portion 40 protrudes toward the outside of the roller portion 26. The protruding portion 40 protrudes along the axial direction of the roller portion 26.

A cylindrical protruding portion 42 (see FIGS. 3 and 4) is provided at the other end in the axial direction of the roller portion 26. The outer diameter of the protruding portion 42 is smaller than the outer diameter of the roller portion 26. The inner diameter of the protruding portion 42 is smaller than the inner diameter of the roller portion 26. The inner side of the protruding portion 42 communicates with the hollow portion 36.

The protruding portion 40 provided at one end of the roller portion 26 and the protruding portion 42 provided at the other end of the roller portion 26 are attached to a support mechanism (not shown) via bearings 44. Thus, the roller portion 26 can rotate relative to the shaft portion 28.

The roller portion 26 is formed with a plurality of through holes 46. The through holes 46 are arranged at intervals in the circumferential direction of the roller portion 26 (see FIG. 2). The through holes 46 are also arranged in the axial direction of the roller portion 26 (see FIGS. 3 and 4). The number and the shape of the through holes 46 are not particularly limited. Each through hole 46 penetrates from the outer peripheral surface to the inner peripheral surface of the roller portion 26. Therefore, each through hole 46 connects the outer side of the roller portion 26 and the hollow portion 36, which is located on the inner side of the roller portion 26.

The shaft portion 28 is disposed on the inner side of the roller portion 26. The shaft portion 28 extends along the axial direction of the roller portion 26. The axis of the shaft portion 28 coincides with the rotary axis Ax of the roll device 20. The shaft portion 28 includes a first shaft portion 48 and a second shaft portion 50. The first shaft portion 48 is disposed in the hollow portion 36. A part of the second shaft portion 50 is disposed on the inner side of the protruding portion 42, and the other part of the second shaft portion 50 extends outward from the protruding portion 42. The outer diameter of the second shaft portion 50 is smaller than the outer diameter of the first shaft portion 48.

The shaft portion 28 may be rotatably supported by a support mechanism (not shown) or may be non-rotatably secured to a support mechanism (not shown). In the present embodiment, the shaft portion 28 is secured to a support mechanism (not shown) so as not to rotate.

The heating portion 30 heats the film-attached sheet 12. The shaft portion 28 is provided with the heating portion 30. The heating portion 30 includes a heating chamber 52 and a hot air supply path 54. The heating chamber 52 is formed by cutting out a part of the surface of the first shaft portion 48. The heating chamber 52 communicates with a part of the plurality of through holes 46. The hot air supply path 54 communicates with the heating chamber 52 and is connected to a hot air supply machine 55 (FIG. 1). The roll device 20 or a device other than the roll device 20 may be provided with the hot air supply machine 55.

The hot air output from the hot air supply machine 55 is supplied to the heating chamber 52 through the hot air supply path 54. The heating portion 30 supplies, through the through holes 46 communicating with the heating chamber 52, hot air to the film-attached sheet 12 from the other surface F2 of the sheet 14 being in contact with the outer peripheral surface of the roller portion 26.

The suction portion 32 sucks the sheet 14. The shaft portion 28 is formed with the suction portion 32. The suction portion 32 includes a suction chamber 56 and a suction path 58. The suction chamber 56 is formed by cutting out a part of the surface of the first shaft portion 48. The suction chamber 56 is disposed adjacent to the heating chamber 52 with a slight gap from the heating chamber 52 in the rotational direction of the roller portion 26. The suction chamber 56 is not in communication with the heating chamber 52 or the hot air supply path 54. The suction chamber 56 communicates with a part of the plurality of through holes 46 that are different from the through holes 46 communicating with the heating chamber 52. The suction path 58 communicates with the suction chamber 56 and is connected to a suction machine 59 (FIG. 1). The roll device 20 or a device other than the roll device 20 may be provided with the suction machine 59.

The suction machine 59 generates a negative pressure in the suction chamber 56 through the suction path 58. Through the through holes 46 communicating with the suction chamber 56 that is in negative pressure, the suction portion 32 sucks the sheet 14 that is in contact with the outer peripheral surface of the roller portion 26.

The discharge portion 34 discharges gas to the sheet 14. The shaft portion 28 is provided with the discharge portion 34. The discharge portion 34 includes a discharge chamber 60 and a discharge path 62. The discharge chamber 60 is formed by cutting out a part of the surface of the first shaft portion 48. The discharge chamber 60 is disposed adjacent to the suction chamber 56 with a slight gap from the suction chamber 56 in the rotational direction of the roller portion 26. The discharge chamber 60 is not in communication with the heating chamber 52, the hot air supply path 54, the suction chamber 56, or the suction path 58. The discharge chamber 60 communicates with a part of the through holes 46 different from the through holes 46 communicating with the heating chamber 52 and the suction chamber 56. The discharge chamber 60 may be smaller than the heating chamber 52 and the suction chamber 56. The discharge path 62 communicates with the discharge chamber 60 and is connected to a gas supply machine 63 (FIG. 1). The roll device 20 or a device other than the roll device 20 may be provided with the gas supply machine 63.

Gas output from the gas supply machine 63 is supplied to the discharge chamber 60 via the discharge path 62. The discharge portion 34 discharges, through the through holes 46 communicating with the discharge chamber 60, gas to the sheet 14 from the other surface F2 of the sheet 14 being brought into contact with the outer peripheral surface of the roller portion 26.

A conveyance method using the sheet conveyance apparatus 10 described above for conveying the sheet 14 while peeling the protective film 16 of the film-attached sheet 12 will be described. First, an end portion of the film-attached sheet 12 wound on the reeling-out roll 18 is attached to the peeling unit 22 and the reeling-in roll 24. That is, the protective film 16 at the end portion of the film-attached sheet 12 is peeled off from the sheet 14 and attached to the peeling unit 22. On the other hand, the sheet 14 from which the protective film 16 has been peeled off is laid over the roller portion 26, and an end portion of the sheet 14 is attached to the reeling-in roll 24.

Thereafter, the conveyance operation is started. That is, the reeling-out roll 18 rotates at a predetermined reeling-out speed to feed the film-attached sheet 12 to the roll device 20. Further, the peeling unit 22 peels the protective film 16 at a predetermined peeling speed, and the reeling-in roll 24 reels the sheet 14 in at a predetermined reeling-in speed. Further, the roller portion 26 of the roll device 20 is rotated at a predetermined rotational speed. This rotational speed is set in advance as a default speed based on the reeling-out speed, the peeling speed, the reeling-in speed, the friction between the sheet 14 and the roller portion 26, and the like.

When the conveyance operation is started, a heating step, a suction step, and a discharge step are performed in this order at the roll device 20. In the heating step, the heating portion 30 supplies, through the through holes 46 communicating with the heating chamber 52, hot air to the film-attached sheet 12 from the other surface F2 of the sheet 14 being brought into contact with the outer peripheral surface of the roller portion 26. Thus, the film-attached sheet 12 is heated and the protective film 16 is softened. As a result, the protective film 16 is easily peeled off the sheet 14.

In the suction step, the suction portion 32 sucks, through the through hole 46 communicating with the suction chamber 56 in negative pressure, the sheet 14 from the other surface F2 of the sheet 14 being brought into contact with the outer peripheral surface of the roller portion 26. Thus, the protective film 16 is easily peeled off the sheet 14.

In the discharge step, the discharge portion 34 discharges, through the through holes 46 communicating with the discharge chamber 60, gas to the sheet 14 from the other surface F2 of the sheet 14 being brought into contact with the outer peripheral surface of the roller portion 26. Thus, a load can be applied to the sheet 14 in a direction away from the roller portion 26. As a result, it is possible to prevent the sheet 14 from being reeled in in a state where the suction load from the suction portion 32 is excessively applied to the sheet 14, and it is possible to prevent the sheet 14 from being damaged.

Figure 5:
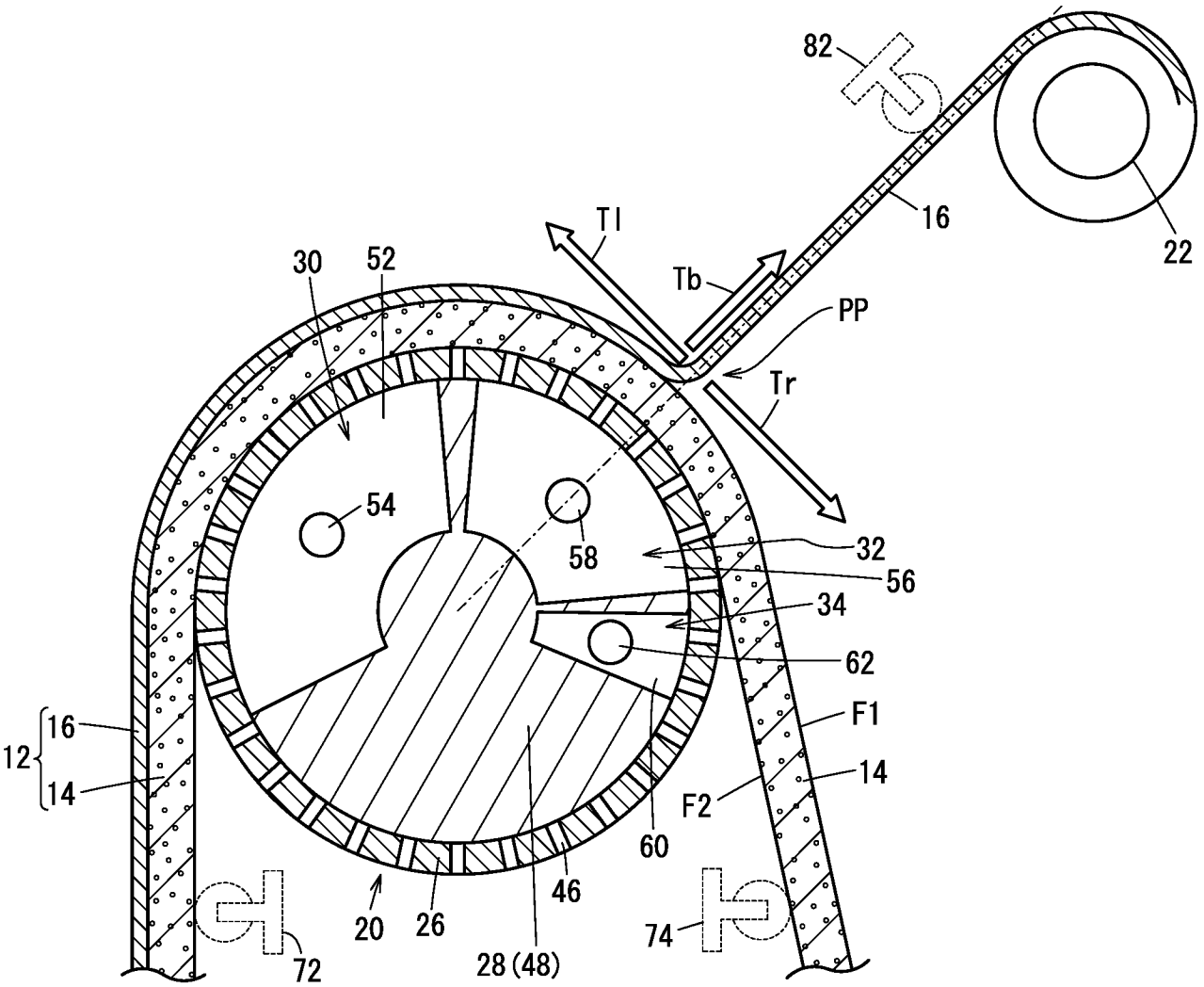
FIG. 5 is a conceptual diagram showing the relationship of tension when a peeling position where a protective film peels off a sheet is arranged at an ideal position.

FIG. 5 is a conceptual diagram showing the relationship of tension when the peeling position PP where the protective film 16 is peeled off the sheet 14 is arranged at an ideal position. When the peeling position PP is at an ideal position, the balance between the first tension Tl and the second tension Tr is substantially the same. In other words, the first tension Tl and the second tension Tr are substantially equal. The first tension Tl is the tension of the film-attached sheet 12 fed to the roller portion 26. The second tension Tr is the tension of the sheet 14 reeled in by the roller portion 26.

Figure 6:
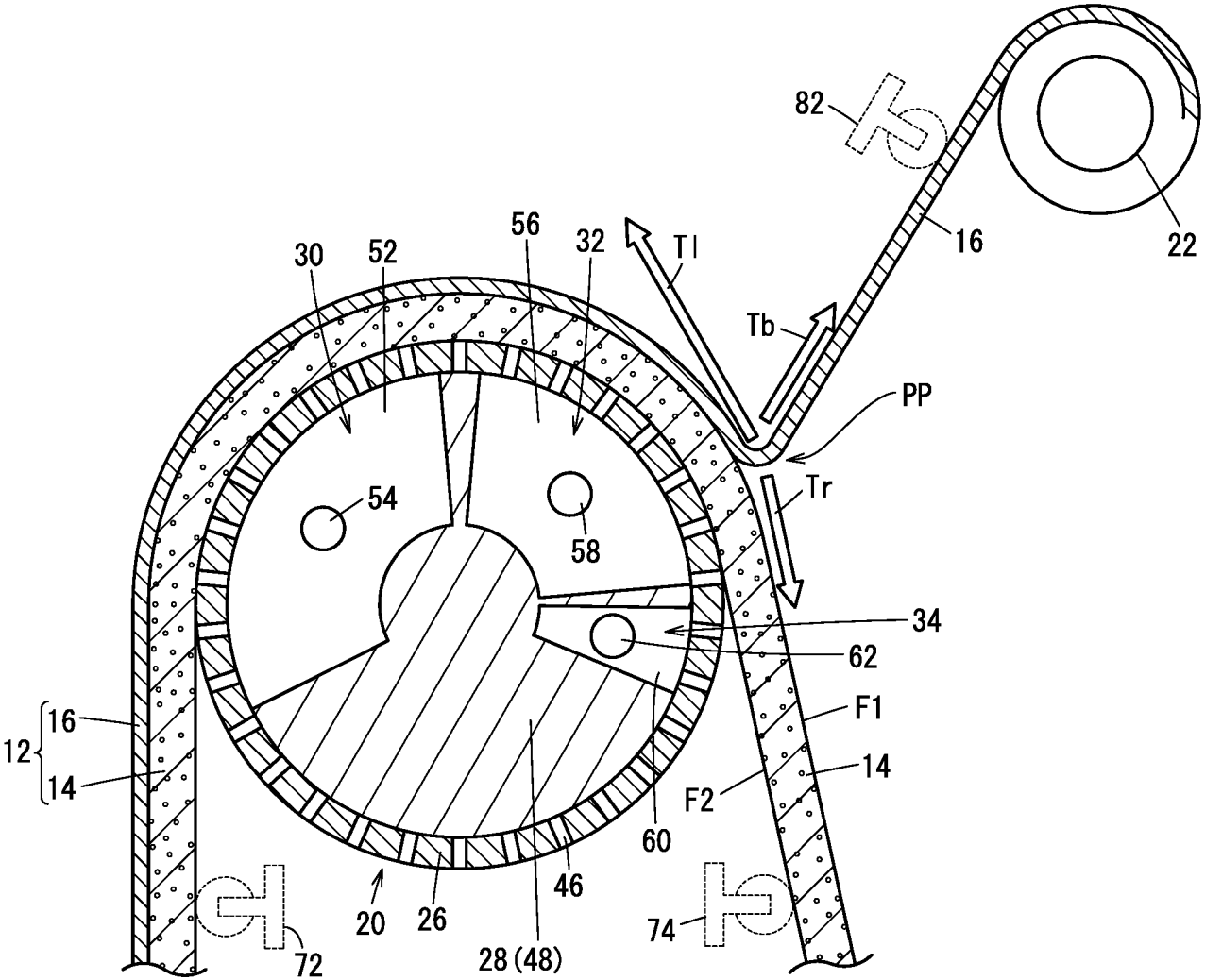
FIG. 6 is a conceptual diagram showing the relationship of tension when the peeling position where the protective film peels off the sheet is shifted from the ideal position in the traveling direction of the sheet.

FIG. 6 is a conceptual diagram showing the relationship of tension when the peeling position PP where the protective film 16 peels off the sheet 14 is shifted from the ideal position in the traveling direction of the sheet 14. Depending on fluctuations in the rotational speed of the reeling-out roll 18 or the peeling-in roll 24, the sheet 14 may be displaced from the ideal position in the traveling direction of the sheet 14. In this case, the first tension Tl and the second tension Tr are not equal. Specifically, a component of the third tension Tb is added to the first tension Tl, whereby the first tension Tl becomes larger than the second tension Tr. The third tension Tb is the tension of the protective film 16 peeled off the sheet 14 by the peeling unit 22.

Also, when the sheet 14 is displaced from the ideal position in the direction opposite to the traveling direction of the sheet 14 (not shown), the first tension Tl and the second tension Tr become unequal. In this case, the first tension Tl becomes smaller than the second tension Tr.

When the first tension Tl and the second tension Tr become unequal, an unnecessary load is applied to the sheet 14. As a result, damage or the like is likely to be caused to the sheet 14. Therefore, in the present embodiment, the rotation of the roller portion 26 is controlled in a manner that the peeling position PP falls within a predetermined range including the ideal position.

[Control Device According to First Embodiment]

Figure 7:
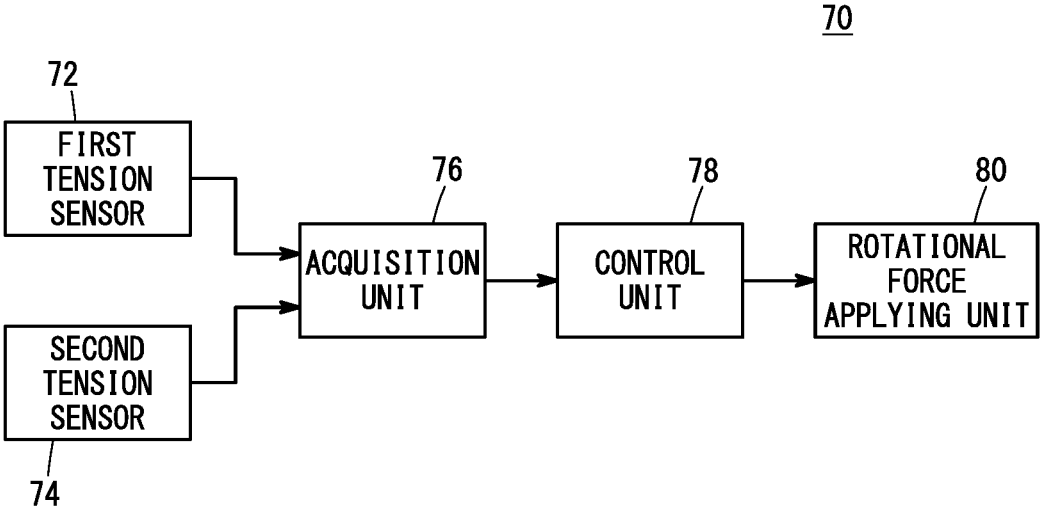
FIG. 7 is a block diagram showing a control device according to the first embodiment.

FIG. 7 is a block diagram showing a control device 70 according to the first embodiment. The control device 70 controls the roll device 20. The control device 70 includes a first tension sensor 72, a second tension sensor 74, an acquisition unit 76, a control unit 78, and a rotational force applying unit 80.

The first tension sensor 72 is a sensor for detecting the first tension Tl. The first tension sensor 72 is disposed between the roller portion 26 and the reeling-out roll 18 (see FIG. 5). The first tension sensor 72 detects a first tension Tl between the roller portion 26 and the reeling-out roll 18.

The second tension sensor 74 is a sensor for detecting the second tension Tr. The second tension sensor 74 is disposed between the roller portion 26 and the peeling-in roll 24 (see FIG. 5). The second tension sensor 74 detects the second tension Tr between the roller portion 26 and the peeling-in roll 24.

The acquisition unit 76 acquires information indicating the peeling position PP. In the present embodiment, the acquisition unit 76 calculates a difference (tension difference) between the first tension Tl and the second tension Tr as information indicating the peeling position PP. The acquisition unit 76 calculates a tension difference by subtracting the second tension Tr from the first tension Tl. The absolute value of the tension difference indicates the amount of deviation of the peeling position PP from the ideal position, and the positive or negative sign of the tension difference indicates the direction of deviation of the peeling position PP from the ideal position.

The relationship between the positive or negative sign of the tension difference and the direction of the deviation of the peeling position PP from the ideal position differs depending on the way of subtraction. That is, when the second tension Tr is subtracted from the first tension Tl and the tension difference becomes positive, the direction in which the peeling position PP deviates from the ideal position becomes the traveling direction of the sheet 14 (see FIG. 6). On the other hand, when the tension difference becomes negative, the direction in which the peeling position PP deviates from the ideal position becomes the direction opposite to the traveling direction of the sheet 14.

On the other hand, when the first tension Tl is subtracted from the second tension Tr and the tension difference becomes positive, the direction of the deviation of the peeling position PP from the ideal position becomes the direction opposite to the traveling direction of the sheet 14. On the other hand, when the tension difference becomes negative, the direction of the deviation of the peeling position PP from the ideal position becomes the traveling direction of the sheet 14 (see FIG. 6).

The control unit 78 controls the rotational force applying unit 80 to rotate the roller portion 26. In the present embodiment, the rotational force applying unit 80 is a motor. That is, the control unit 78 outputs to the rotational force applying unit 80 a command value for rotating the roller portion 26 in the rotational direction corresponding to the traveling direction of the sheet 14 at the default rotational speed. The rotational force applying unit 80 applies a rotational force to the roller portion 26 in accordance with the command value. Thus, the roller portion 26 rotates in the rotational direction corresponding to the traveling direction of the sheet 14 at the default rotational speed.

Further, the control unit 78 adjusts the rotational speed of the roller portion 26 based on the tension difference, thereby moving the peeling position PP. When there is no tension difference, the control unit 78 determines that the position of the peeling position PP is at the ideal position (see FIG. 5). In this case, the control unit 78 does not adjust the rotational speed of the roller portion 26. Therefore, the roller portion 26 rotates in the rotational direction corresponding to the traveling direction of the sheet 14 at the default rotational speed.

On the other hand, when there is a tension difference, the control unit 78 determines that the position of the peeling position PP is not at the ideal position. As described above, in the present embodiment, the tension difference is obtained by subtracting the second tension Tr from the first tension Tl. Therefore, when the tension difference is positive, the first tension Tl is larger than the second tension Tr (see FIG. 6). In this case, as the absolute value of the tension difference becomes larger, the control unit 78 proportionately sets the rotational speed to be slower than the default rotational speed. As a result, the peeling position PP moves in the direction opposite to the traveling direction of the sheet 14. As a result, the tension difference between the first tension Tl and the second tension Tr is reduced.

Conversely, when the tension difference is negative, the first tension Tl is smaller than the second tension Tr. In this case, as the absolute value of the tension difference becomes larger, the control unit 78 proportionately sets the rotational speed to be higher than the default rotational speed. Thus, the peeling position PP moves in the traveling direction of the sheet 14. As a result, the tension difference between the first tension Tl and the second tension Tr is reduced.

Thus, in the first embodiment, when there is a tension difference, the control unit 78 controls the rotational force applying unit 80 so as to reduce the tension difference and moves the peeling position PP.

[Control Device According to Second Embodiment]

Figure 8:
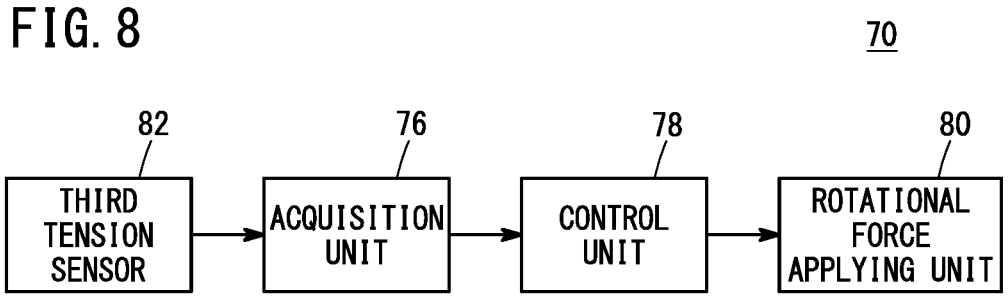
FIG. 8 is a block diagram showing a control device according to the second embodiment.

FIG. 8 is a block diagram showing a control device 70 according to the second embodiment. In FIG. 8, components equivalent to those described above are denoted by the same reference numerals. In the present embodiment, descriptions that overlap with those described above are omitted.

The control device 70 according to the present embodiment includes a third tension sensor 82 in place of the first tension sensor 72 and the second tension sensor 74.

The third tension sensor 82 is a sensor for detecting the third tension Tb. The third tension Tb is the tension of the protective film 16 peeled off the sheet 14 by the peeling unit 22 as described above. The third tension sensor 82 is disposed between the roller portion 26 and the peeling unit 22 (see FIG. 5). The third tension sensor 82 detects a third tension Tb between the roller portion 26 and the peeling unit 22.

The acquisition unit 76 acquires, as information indicating the peeling position PP, the third tension Tb detected by the third tension sensor 82. The control unit 78 adjusts the rotational speed of the roller portion 26 based on the third tension Tb, thereby moving the peeling position PP.

In the control unit 78, are set in advance an upper limit value and a lower limit value of a range in which the sheet 14 can withstand an unnecessary load even when the peeling position PP is not at an ideal position. The upper and lower limit values are set based on the strength of the sheet 14 or the like.

When the third tension Tb exceeds a predetermined upper limit value, the direction in which the peeling position PP deviates from the ideal position becomes the traveling direction of the sheet 14. Further, as the absolute value of the difference between the third tension Tb and the upper limit value becomes larger, the amount of deviation of the peeling position PP from the ideal position proportionately becomes larger.

On the other hand, when the third tension Tb is less than the predetermined lower limit value, the direction in which the peeling position PP deviates from the ideal position becomes the direction opposite to the traveling direction of the sheet 14. Further, as the absolute value of the difference between the third tension Tb and the lower limit value becomes larger, the amount of deviation of the peeling position PP from the ideal position proportionately becomes larger.

That is, the third tension Tb becomes information indicating the peeling position PP. When the third tension Tb is equal to or less than a predetermined upper limit value and the third tension Tb is equal to or more than a predetermined lower limit value, the control unit 78 determines that the peeling position PP is within an acceptable range. In this case, the control unit 78 does not adjust the rotational speed of the roller portion 26. Therefore, the roller portion 26 rotates in the rotational direction corresponding to the traveling direction of the sheet 14 at the default rotational speed.

On the other hand, when the third tension Tb exceeds the predetermined upper limit value, the control unit 78 determines that the peeling position PP is not within the acceptable range. In this case, as the absolute value of the difference between the third tension Tb and the upper limit value becomes larger, the control unit 78 proportionately sets the rotational speed to be slower than the default rotational speed. As a result, the peeling position PP moves in the direction opposite to the traveling direction of the sheet 14.

On the other hand, when the third tension Tb is less than the predetermined lower limit value, the control unit 78 determines that the peeling position PP is not within the acceptable range. In this case, as the absolute value of the difference between the third tension Tb and the lower limit value becomes larger, the control unit 78 proportionately sets the rotational speed to be higher than the default rotational speed. Thus, the peeling position PP moves in the traveling direction of the sheet 14.

As described above, in the second embodiment, the rotational force applying unit 80 is controlled in a manner that the third tension Tb falls within a range in which the strength of the sheet 14 can withstand, and the peeling position PP is moved.

[Modifications]

The above-described embodiments may be modified as follows.

(Modification 1)

Figure 9:
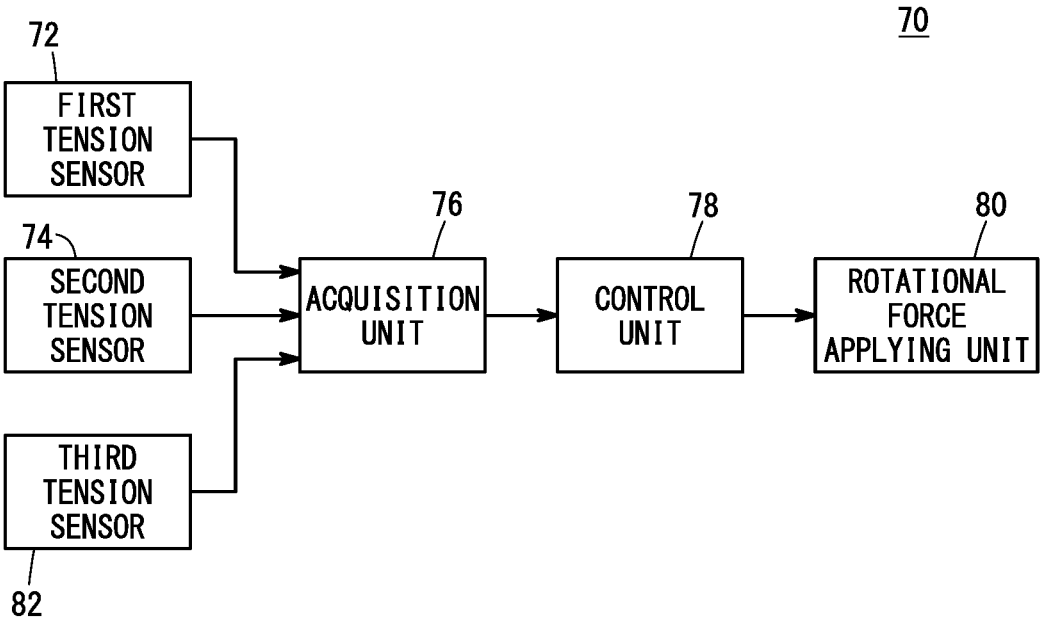
FIG. 9 is a block diagram showing a control device according to the first modification.

FIG. 9 is a block diagram showing a control device 70 according to the first modification. In FIG. 9, components equivalent to those described above are denoted by the same reference numerals. In this modification, descriptions that overlap with those described above will be omitted.

The control device 70 according to this modification is configured based on the combination of the first embodiment and the second embodiment. The control device 70 according to the present modification includes the first tension sensor 72, the second tension sensor 74, the third tension sensor 82, the acquisition unit 76, the control unit 78, and the rotational force applying unit 80.

The acquisition unit 76 acquires the first tension Tl, the second tension Tr, and the third tension Tb as information indicating the peeling position PP. The control unit 78 controls the rotational force applying unit 80 so as to reduce the tension difference between the first tension Tl and the second tension Tr when the third tension Tb goes out of a predetermined range.

That is, when the third tension Tb exceeds the predetermined upper limit value, the control unit 78 proportionately sets the rotational speed to be slower than the default rotational speed as the absolute value of the tension difference becomes larger. As a result, the peeling position PP moves in the direction opposite to the traveling direction of the sheet 14.

On the other hand, when the third tension Tb is less than the predetermined lower limit value, the control unit 78 proportionately sets the rotational speed to be higher than the default rotational speed as the absolute value of the tension difference becomes larger. Thus, the peeling position PP moves in the traveling direction of the sheet 14.

(Modification 2)

Figure 10:
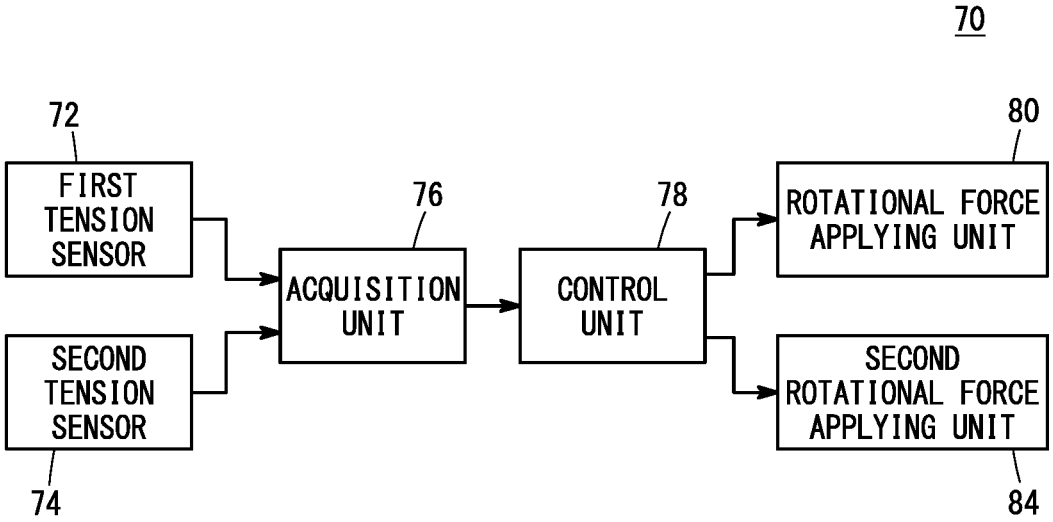
FIG. 10 is a block diagram showing a control device according to a second modification.

FIG. 10 is a block diagram showing a control device 70 according to a second modification. In FIG. 10, components equivalent to those described above are denoted by the same reference numerals. In this modification, descriptions that overlap with those described above will be omitted. In the above-described embodiment, the shaft portion 28 is secured to a support mechanism (not shown) so as not to rotate. In this modification, the shaft portion 28 is rotatably supported by a support mechanism (not shown).

In addition to the first tension sensor 72, the second tension sensor 74, the acquisition unit 76, the control unit 78, and the rotational force applying unit 80 of the first embodiment, the control device 70 according to the present modification includes a second rotational force applying unit 84.

The second rotational force applying unit 84 applies a rotational force to the shaft portion 28 in accordance with a command value given from the control unit 78. The second rotational force applying unit 84 may be a motor (shaft portion motor) for rotationally driving the shaft portion 28.

The control unit 78 controls the second rotational force applying unit 84 to rotate the shaft portion 28. That is, the control unit 78 determines an amount of rotation and a direction of rotation of the shaft portion 28 based on the tension difference and outputs to the second rotational force applying unit 84 a command value for rotating the shaft portion 28 by the amount of rotation in the direction of rotation.

The amount and direction of rotation of the shaft portion 28 is determined as follows. When the tension difference is positive, as described above, the peeling position PP where the protective film 16 peels off the sheet 14 is shifted from the ideal position in the traveling direction of the sheet 14 (see FIG. 6). In this case, the control unit 78 determines the direction of rotation of the shaft portion 28 to be a second rotational direction opposite to a first rotational direction. The first rotational direction is a rotational direction corresponding to the traveling direction of the sheet 14, and the second rotational direction is a rotational direction corresponding to the direction opposite to the traveling direction of the sheet 14. Further, the control unit 78 determines the amount of rotation of the shaft portion 28 in a manner that the amount of movement of the shaft portion 28 from the current position proportionately becomes larger as the absolute value of the tension difference becomes larger.

On the contrary, when the tension difference is negative, as described above, the peeling position PP of the protective film 16 from the sheet 14 is shifted from the ideal position in the direction opposite to the traveling direction of the sheet 14. In this case, the control unit 78 determines the direction of rotation of the shaft portion 28 to be the first rotational direction. Further, the control unit 78 determines the amount of rotation of the shaft portion 28 in a manner that the amount of movement of the shaft portion 28 from the current position proportionately becomes larger as the absolute value of the tension difference becomes larger.

In this way, the control unit 78 rotates the shaft portion 28 based on the tension difference. Thus, the relative positions of a heating position, a suction position, and a discharge position with respect to the peeling position PP can be arranged appropriately. The heating position is a position where the heating portion 30 heats the film-attached sheet 12. The suction position is a position where the suction portion 32 sucks the sheet 14. The discharge position is a position at which the discharge portion 34 discharges gas to the sheet 14.

The control unit 78 may be able to select which of the rotational force applying unit 80 and the second rotational force applying unit 84 to control. For example, the rotational force applying unit 80 or the second rotational force applying unit 84 is set as a control target according to an operation of the user. The control unit 78 selects one of the rotational force applying unit 80 and the second rotational force applying unit 84, which has been set according to the user's operation.

The second rotational force applying unit 84 may be incorporated in the control device 70 of the second embodiment or the control device 70 of the first modification.

(Modification 3)

The control unit 78 of the control device 70 according to the first embodiment may adjust the rotational speed of the roller portion 26 when the absolute value of the tension difference exceeds a predetermined threshold value. Thus, it is possible to suppress unstable rotation of the roller portion 26 caused by hunting that occurs in the process of control. As a result, the sheet 14 conveyed to the roller portion 26 can be protected from damage or the like.

(Modification 4)

The control unit 78 of the control device 70 according to the first embodiment or the second embodiment may move the peeling position PP by adjusting the rotational speed of the roller portion 26 based on the reeling-in speed of the reeling-in roll 24. As the reeling-in speed becomes faster than the predetermined value, the direction in which the peeling position PP deviates from the ideal position becomes the traveling direction of the sheet 14. On the other hand, as the reeling-in speed becomes slower than the predetermined value, the direction in which the peeling position PP deviates from the ideal position becomes opposite to the traveling direction of the sheet 14. That is, the reeling-in speed becomes information indicating the peeling position PP.

The control unit 78 measures the reeling-in speed based on a signal output from an encoder of a reeling-in drive motor for driving the reeling-in roll 24. When the reeling-in speed exceeds a predetermined upper limit value, the control unit 78 determines that the peeling position PP is not within an acceptable range. In this case, the control unit 78 proportionately sets the rotational speed to be slower than the default rotational speed as the absolute value of the difference between the reeling-in speed and the upper limit value becomes larger. As a result, the peeling position PP moves in the direction opposite to the traveling direction of the sheet 14.

On the other hand, when the reeling-in speed is less than a predetermined lower limit value, the control unit 78 determines that the peeling position PP is not within the acceptable range. In this case, the control unit 78 proportionately sets the rotational speed higher than the default rotational speed as the absolute value of the difference between the reeling-in speed and the lower limit value becomes larger. Thus, the peeling position PP moves in the traveling direction of the sheet 14.

Similarly to the above, the control unit 78 may move the peeling position PP by adjusting the rotational speed of the roller portion 26 based on the reeling-out speed of the reeling-out roll 18.

(Modification 5)

Air taken in from the suction chamber 56 by the suction portion 32 may flow into the discharge chamber 60. In this case, the discharge portion 34 discharges to the sheet 14 the air taken in from the suction chamber 56 by the suction portion 32. Therefore, even if there is no gas supply machine, a load can be applied to the sheet 14 in the direction away from the roller portion 26.

(Modification 6)

The heating portion 30 may be not incorporated in the shaft portion 28. In this case, the heating portion 30 may be disposed between the reeling-out roll 18 and the roller portion 26. When the heating portion 30 is disposed between the reeling-out roll 18 and the roller portion 26, hot air can be supplied to the film-attached sheet 12 before the film-attached sheet 12 reaches the roller portion 26.

[Present Invention]

The present invention is not limited to the above-described embodiments and modifications, and various configurations can be adopted without departing from the gist of the present invention. The effects that can be understood from the above description will be described below.

(1) The present invention is a sheet conveyance apparatus (10) including a roll device (20) that guides a film-attached sheet (12) include a sheet (14) and a protective film (16) attached to one surface (F1) of the sheet, a peeling unit (22) that peels the protective film of the film-attached sheet guided by the roll device, an acquisition unit (76) that acquires information indicating a peeling position (PP) where the protective film is peeled off the sheet, and a control unit (78) that controls the roll device based the information and moves the peeling position.

Thus, it is possible to suppress the change of the peeling position. Accordingly, it is possible to suppress the change of the tension applied to the sheet and the application of an unnecessary load to the sheet. As a result, damage or the like to the sheet can be suppressed.

(2) The present invention is the sheet conveyance apparatus wherein the roll device may include a roller portion (26) with which another surface (F2) of the sheet opposite to the one surface is brought into contact and that is rotatably supported, and a rotational force applying unit (80) that applies a rotational force to the roller portion, wherein the control unit controls the rotational force applying unit and moves the peeling position. Thus, the peeling position can be moved to an appropriate position by the rotational force applied to the roller portion.

(3) The present invention is the sheet conveyance apparatus wherein the information may include a tension difference between tension of the film-attached sheet fed to the roller portion and tension of the sheet reeled in from the roller portion, and in a case where there is the tension difference, the control unit may control the rotational force applying unit so as to reduce the tension difference and move the peeling position. Thus, changes in tension applied to the sheet can be appropriately suppressed by a rotational force applied to the roller portion.

(4) The present invention is the sheet conveyance apparatus wherein the control unit may control the rotational force applying unit in a case where the tension difference is equal to or greater than a predetermined threshold value. Thus, it is possible to suppress unstable rotation of the roller portion caused by hunting that occurs in the process of control.

(5) The present invention is the sheet conveyance apparatus wherein the information may include tension of the protective film having been peeled off the sheet, and in a case where the tension is out of a predetermined range, the control unit may control the rotational force applying unit in a manner that the tension is within the predetermined range and move the peeling position. Thus, changes in tension applied to the sheet can be appropriately suppressed by a rotational force applied to the roller portion. Further, it is possible to suppress unstable rotation of the roller portion caused by hunting that occurs in the process of control.

(6) The present invention is the sheet conveyance apparatus wherein the information may include first tension (Tl) that is tension of the film-attached sheet fed to the roller portion, second tension (Tr) that is tension of the sheet reeled in from the roller portion, and third tension (Tb) that is tension of the protective film having been peeled off the sheet, and in a case where the third tension is out of a predetermined range, the rotational force applying unit may be controlled so as to reduce a tension difference between the first tension and the second tension, and the peeling position is moved. Thus, changes in tension applied to the sheet can be appropriately suppressed by a rotational force applied to the roller portion. Further, it is possible to suppress unstable rotation of the roller portion caused by hunting that occurs in the process of control.

(7) The present invention is the sheet conveyance apparatus wherein the roll device may include a plurality of through holes (46) that are arranged at intervals in a circumferential direction of the roller portion and penetrate from an outer peripheral surface to an inner peripheral surface of the roller portion, a shaft portion (28) that is disposed on an inner side of the roller portion, and a suction portion (32) that is provided at the shaft portion and sucks the sheet from another surface through the through holes. Thus, the protective film can be easily peeled off the sheet.

(8) The present invention is the sheet conveyance apparatus including a discharge portion (34) that is formed at the shaft portion and discharges gas to the sheet from another surface to the sheet via the through holes. Thus, a load can be applied to the sheet in the direction away from the roller portion. As a result, the sheet is prevented from being reeled in in a state where the suction load from the suction portion is excessively applied to the sheet, whereby it is possible to prevent the sheet from being damaged.

The invention claimed is:

1. A sheet conveyance apparatus comprising:

a roll device that guides a film-attached sheet including a sheet and a protective film attached to a first surface of the sheet;

a peeling unit that has a reel-in roll configured to peel the protective film of the film-attached sheet guided by the roll device; and a controller configured to control the roll device, wherein the roll device comprises:

a roller portion that is provided with a plurality of through holes preformed so as to be arranged in a circumferential direction, wherein the roller portion is configured to be brought into contact with a second surface of the sheet opposite to the first surface, and is co-axial with the roll device;

a first rotational force applying unit having a first motor that applies a rotational force to the roller portion;

a shaft portion that is disposed on an inner side of the roller portion, is provided with a suction portion configured to suck the sheet from the second surface side via at least one of the plurality of through holes, and is co-axial with the roll device;

a second rotational force applying unit having a second motor that applies a rotational force to the shaft portion; and a hollow portion formed between the roller portion and the shaft portion, and the controller acquires information indicating a peeling position where the protective film is peeled off the sheet; and the controller controls the roll device based on the information and moves the peeling position.

2. The sheet conveyance apparatus according to claim 1, wherein the information includes a tension difference between tension of the film-attached sheet fed to the roller portion and tension of the sheet reeled in from the roller portion, and in a case where there is the tension difference, the controller controls the first rotational force applying unit so as to reduce the tension difference and moves the peeling position.

3. The sheet conveyance apparatus according to claim 2, wherein the controller controls the first rotational force applying unit in a case where the tension difference is equal to or greater than a predetermined threshold value.

4. The sheet conveyance apparatus according to claim 1, wherein the information includes tension of the protective film having been peeled off the sheet, and in a case where the tension is out of a predetermined range, the controller controls the first rotational force applying unit in a manner that the tension is within the predetermined range, and moves the peeling position.

5. The sheet conveyance apparatus according to claim 1, wherein the information includes first tension that is tension of the film-attached sheet fed to the roller portion, second tension that is tension of the sheet reeled in from the roller portion, and third tension that is tension of the protective film having been peeled off the sheet, and in a case where the third tension is out of a predetermined range, the first rotational force applying unit is controlled so as to reduce a tension difference between the first tension and the second tension, and the peeling position is moved.

6. The sheet conveyance apparatus according to claim 1, further a discharge portion that is formed at the shaft portion and discharges gas to the sheet from the second surface side via the through holes.

7. The sheet conveyance apparatus according to claim 6, further comprising a heating portion that is formed at the shaft portion and supplies hot air to the film-attached sheet through the through holes.

8. The sheet conveyance apparatus according to claim 7, wherein the controller controls the second rotational force applying unit based on the peeling position so as to arrange a heating position of the heating portion, a suction position of the suction portion, and a discharge position of the discharge portion at appropriate relative positions.

* * * * *